US005205005A

United States Patent [19]

Merrill et al.

[11] Patent Number: 5,205,005

[45] Date of Patent: Apr. 27, 1993

[54] BED ELEVATING APPARATUS

[76] Inventors: Thomas H. Merrill; Debra L. Merrill, both of 1911 Pin Oak Cir., Norman, Okla. 73072

[21] Appl. No.: 926,260

[22] Filed: Aug. 6, 1992

[51] Int. Cl.[5] ..... A47C 21/00

[52] U.S. Cl. ..... 5/660; 5/400

[58] Field of Search ..... 5/11, 603, 655, 659, 5/660, 900.5, 400

[56] References Cited

U.S. PATENT DOCUMENTS

| | | | |
|---|---|---|---|
| 10,139 | 10/1853 | Scott | 5/900.5 |
| 136,395 | 3/1873 | Walton | 5/660 |
| 1,195,456 | 8/1916 | Fosburgh . | |
| 1,401,554 | 12/1921 | Phillips . | |
| 1,866,696 | 7/1932 | Birman . | |
| 2,933,850 | 4/1960 | Martin . | |
| 3,087,170 | 4/1963 | Emery . | |
| 3,259,921 | 7/1966 | Alsobrook, Jr. | 5/660 |
| 3,795,925 | 3/1974 | Leagus, Jr. . | |
| 3,952,346 | 4/1976 | Carlson | 5/660 |
| 4,181,989 | 1/1980 | Bradley et al. . | |
| 4,535,494 | 8/1985 | Diamonstein | 5/400 |
| 4,566,449 | 1/1986 | Smith | 5/655 |
| 4,807,313 | 2/1989 | Ryder et al. | 5/660 |
| 4,819,282 | 4/1989 | McArthur et al. | 5/655 |
| 4,935,978 | 6/1990 | Luchonok et al. | 5/900.5 |
| 4,942,633 | 7/1990 | Thomas et al. | 5/11 |

FOREIGN PATENT DOCUMENTS 2801726 1/1979 Fed. Rep. of Germany ..... 5/660

*Primary Examiner*—Peter M. Cuomo
*Assistant Examiner*—Michael Milano
*Attorney, Agent, or Firm*—Dunlap, Codding & Lee

[57] ABSTRACT

A bed elevating apparatus comprising an elevation frame having a first end and a second end, an upper surface and a lower surface wherein the lower surface is supportable on a bed frame with the first end of the elevation frame being disposed near a first end of the bed frame and the second end of the elevation frame being disposed near a second end of the bed frame. The elevation frame is triangularly shaped in a side elevation and has a first height extending between the upper and the lower surfaces adjacent the first end of the elevation frame and a second height extending between the upper surface and the lower surface of the elevation frame adjacent the second end of the elevation frame with the first height being larger than the second height. A mattress or a box spring and a mattress is supportable on the upper surface of the elevation frame whereby the mattress extends substantially in a single angularly extending plane for supporting one end of the mattress at an elevation higher than the opposite end of the mattress.

12 Claims, 2 Drawing Sheets

BED ELEVATING APPARATUS

BACKGROUND OF THE INVENTION

Field of the Invention

The present invention relates generally to bed elevating devices and, more particularly, but not by way of limitation, to a generally triangularly shaped elevation frame which is supportable on a bed frame for supporting a mattress or a box spring and a mattress on an upper surface of the elevation frame whereby the mattress is supported extending in a substantially single angularly extending plane for supporting one end of the mattress at a height higher than the opposite end of the mattress.

DESCRIPTION OF THE PREFERRED EMBODIMENTS

There are many specific medical illnesses for which bed elevation is indicated. In other words, there are medical illnesses where it is desirable to support one end of a bed at a height greater than the opposite end of the bed for elevating an individual's head or legs. For example, gastro-intestinal related illnesses where elevation of an individual's head during sleeping is indicated as part of the treatment such as reflux-esophagitis, hiatal hernia, achallasis and esophageal stricture. Also, with respect to various respiratory related illnesses, elevation of the individual's head during sleeping is indicated as part of the treatment where such respiratory related illnesses include nocturnal asthma, chronic aspiration (2° to supine position) and refractory CHF and COPD, for example. Other medical illnesses where elevation of an individual's head or legs during sleep is indicated as part of the treatment include varicose veins, chronic edema 2° venous insufficiency, venous stasis ulcers, venous stasis dermatitis, post phlebitic syndrome, for example.

The present invention is adapted to provide a relatively inexpensive, simple, easy to install and easy to disassemble device for elevating one end of a bed whereby the mattress is supported in a substantially single angularly extending plane from one end of the bed to the opposite end of the bed.

Figure 1:
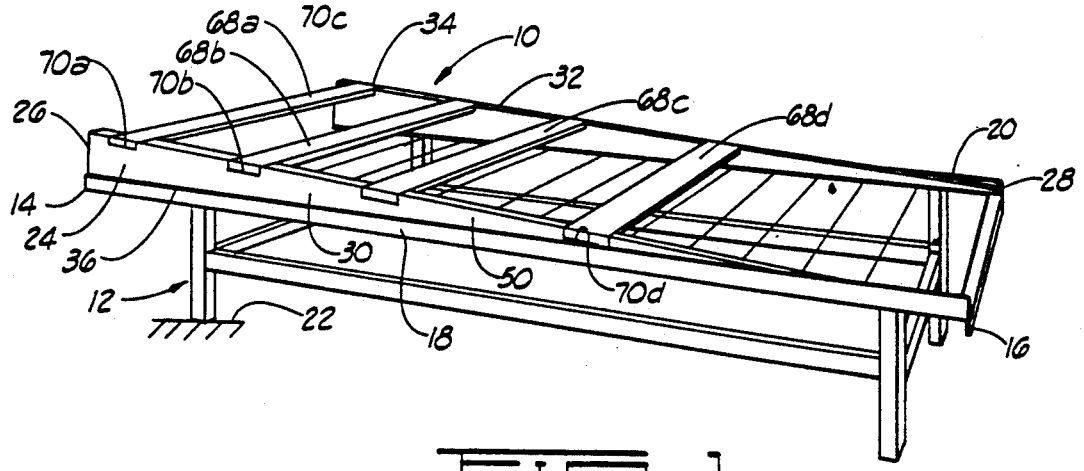
FIG. 1 is a perspective view of a bed elevating apparatus constructed in accordance with the present invention supported on a bed frame.
Figure 2:
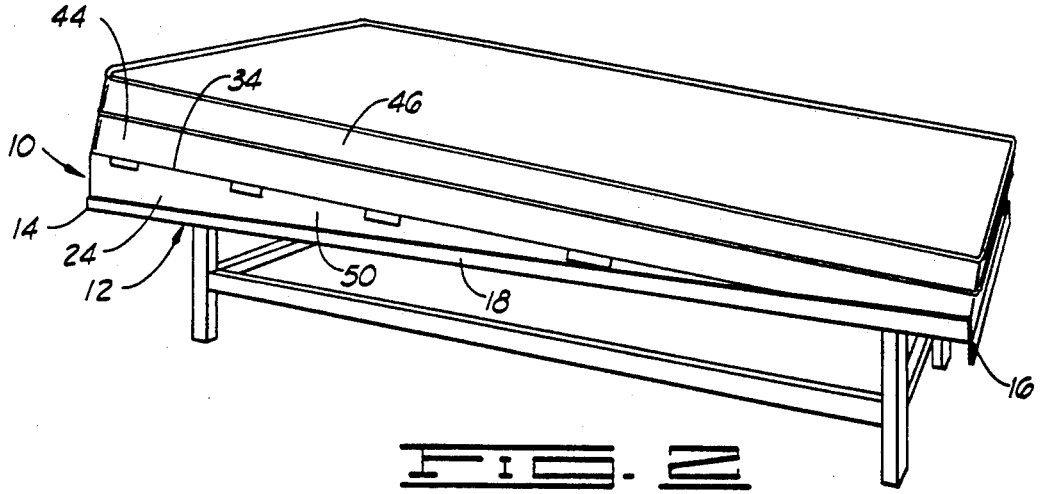
FIG. 2 is a perspective view of the bed elevating apparatus of FIG. 1, but showing a box spring and a mattress supported on the bed elevating apparatus.
Figure 3:
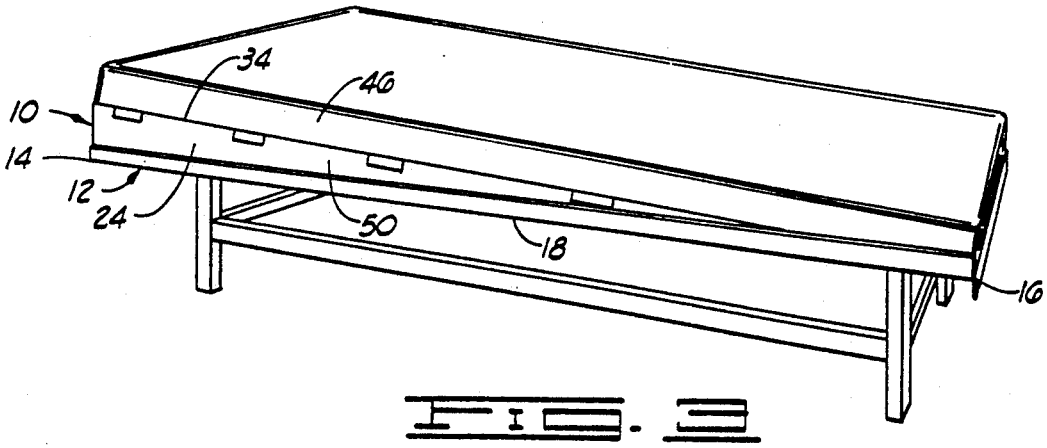
FIG. 3 is a perspective view similar to FIG. 1, but showing a mattress supported on the bed elevating apparatus.

Shown in FIGS. 1, 2, 3, 5 and 6 is a bed elevating apparatus 10 which is constructed in accordance with the present invention. The bed elevating apparatus 10 is adapted for use with a bed frame 12 (FIGS. 1, 2 and 3). As shown in FIGS. 1, 2 and 3, the bed frame 12 has a first end 14, a second end 16 which is spaced a distance from the first end 14, a first side 18 and a second side 20 which is spaced a distance from the first side 18. The bed frame 12 is generally rectangularly shaped and is adapted to be supported on a substantially horizontally extending support surface 22 such as a floor, as diagrammatically shown in FIG. 1.

Figure 5:
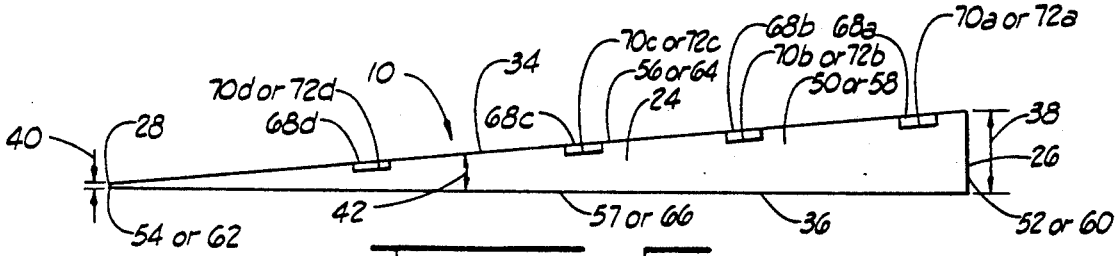
FIG. 5 is a typical side elevation view of a typical side of the bed elevating apparatus of FIG. 1.
Figure 6:
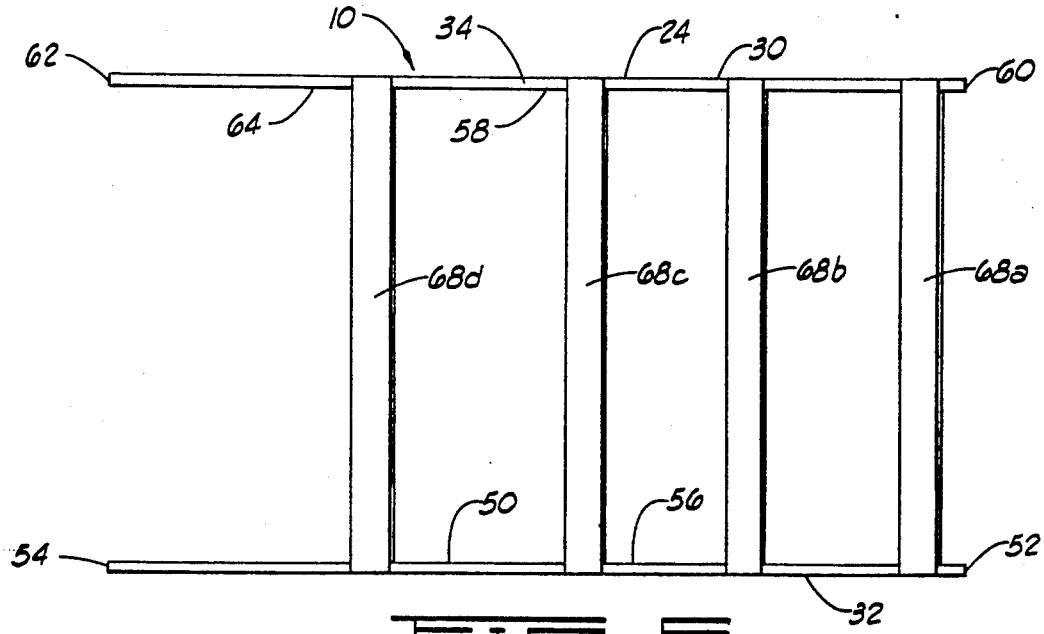
FIG. 6 is a top view of the bed elevating apparatus of FIG. 1.

The bed elevating apparatus 10 comprises an elevation frame 24 (shown more clearly in FIGS. 1, 5 and 6). The elevation frame 24 includes a first end 26, a second end 28 which is spaced a distance from the first end 26, a first side 30 and a second side 32 which is spaced a distance from the first side 30. The elevation frame 24 also includes an upper surface 34 and a lower surface 36.

As illustrated in FIGS. 1, 2 and 3, the lower surface 36 of the elevation frame 24 is supported on the bed frame 12 with the first end 26 of the elevation frame 24 being disposed near the first end 14 of the bed frame 12 and the second end 28 of the elevation frame 24 being disposed near the second end 16 of the bed frame 12. In a preferred embodiment, as illustrated in FIG. 1, the elevation frame 24 extends between the first and the second sides 18 and 20 of the bed frame 12 with the first side 30 of the elevation frame 24 being disposed near the first side 18 of the bed frame 12 and the second side 32 of the elevation frame 24 being disposed near the second side 20 of the bed frame 12.

It should be noted that, in some instances, the elevation frame 24 can be constructed to extend only a partial distance between the first and the second sides 18 and 20 of the bed frame 12 if desired. However, in this last-mentioned instance, it probably would be necessary to use two mattresses and/or box springs and mattress with one set being disposed on the elevation frame 24 and the other set being disposed directly on the bed frame 12. Thus, in this last-mentioned instance, one portion of the bed would be elevated and the other portion of the bed would not be elevated.

The elevation frame 24 has a first height 38 (FIG. 5) extending between the upper surface 34 and the lower surface 36 of the elevation frame 24 about adjacent the first end 26 of the elevation frame 24. The elevation frame 24 also has a second height 40 (FIG. 5) extending between the upper surface 34 and the lower surface 36 of the elevation frame 24 generally near the second end 28 of the elevation frame 24. The first height 38 is larger than the second height 40.

In a preferred form, the elevation frame 24 is about triangularly shaped from a side view and, in this instance as illustrated in the drawings, the second height 40 is virtually zero or, at least, a miniumal distance. However, the elevation frame 24 also could be trapezoidally shaped so the second height 40 would be greater than the second height 40 in those instances where the elevation frame 24 is triangularly shaped. In this last-mentioned embodiment, a sharp edge at the second end 28 of the elevation frame 24 would be eliminated and replaced with a vertically extending abutment if desired in some applications.

The upper surface 34 of the elevation frame 24 extends at an angle 42 (FIG. 5) to the horizontally extending support surface 22 (FIG. 1). The upper surface 34 more particularly extends at the angle 42 in a substantially single angularly extending plane with respect to the support surface 22 from the first end 14 of the bed frame 12 to the second end 16 of the bed frame 12 when the elevation frame 24 is supported on the bed frame 12.

As diagrammatically shown in FIG. 2, a box spring 44 is supported on the upper surface 34 of the elevation frame 24 and a mattress 46 is supported on the box spring 44. In some instances, it may be desirable to support the mattress 46 directly on the upper surface 34 of the elevation frame 24 as illustrated in FIG. 3. In this last-mentioned instance, it also may be desired to interpose the box spring 44 between the elevation frame 24 and the bed frame 12 with the box spring 44 being directly disposed on the bed frame 12 and the elevation frame 24 being disposed on the box spring 44. In any of these instances, the elevation frame 24 is considered to be disposed on the bed frame 12.

Figure 4:
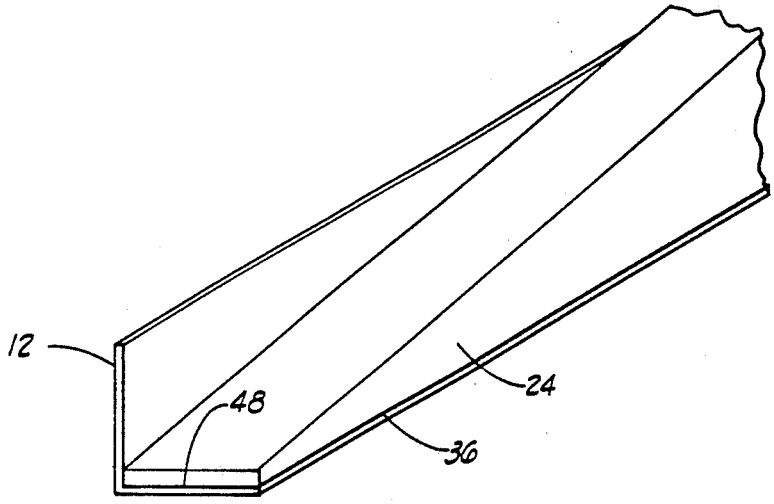
FIG. 4 is a sectional, fragmentary view showing a portion of the bed elevating apparatus of FIG. 1 supported on a support surface of the bed frame (partially shown).

The bed frame 12 includes support surfaces extending between the first and the second ends 14 and 16 of the bed frame 12 which normally are provided for supporting a box spring such as the box spring 44. A typical bed frame support surface 48 is shown in FIG. 4 in cross section. The lower surface 36 of the elevation frame 24 more particularly is disposed on the bed frame support surface 48 of the bed frame 12, although the elevation frame 24 may be adapted to be supported on any portion of the bed frame 12 in any suitable manner.

When the elevation frame 24 is supported on the bed frame 12 and the mattress 46 is supported on the upper surface 34 of the elevation frame 12, the mattress 46 is supported on the elevation frame 12 in a position whereby the mattress 46 extends at the angle 42 to the support surface 22 and the mattress 46 is supported on the elevation frame 24 extending in a substantially single angularly extending plane extending between the first and the second ends 14 and 16 of the bed frame 12.

The elevation frame 24 comprises a first side frame 50 (shown more clearly in FIGS. 1, 3 and 5). The first side frame 50 has a first end 52, a second end 54, an upper surface 56 and a lower surface 57.

The elevation frame 24 also includes a second side frame 58 (shown more clearly in FIGS. 5 and 6). The second side frame 58 includes a first end 60, a second end 62, an upper surface 64 and a lower surface 66.

The first side frame 50 is connected to the second side frame 58 to form the elevation frame. In the connected position, the first ends 52 and 60 of the first and the second side frames 50 and 58 cooperate to form the first end 26 of the elevation frame 24, the second ends 54 and 62 of the first and the second side frames 52 and 58 cooperate to form the second end 28 of the elevation frame 24, the upper surfaces 56 and 64 of the first and the second side frames 50 and 58 cooperate to form the upper surface 34 of the elevation frame 24 and the lower surfaces 57 and 66 of the first and the second side frames 50 and 58 cooperate to form the lower surface 36 of the elevation frame 24.

The first and the second side frames 50 and 58 are secured together in an assembled position by a plurality of slats 68 (4 slats 68 are shown in FIGS. 1 and 6 and the individual slats 68 are designated in FIGS. 1 and 5 by the specific reference numerals 68*a*, 68*b*, 68*c* and 68*d*). Each of the slats 68 has opposite ends with one end of each of the slats 68 being secured to the upper surface 56 of the first side frame 50 and the opposite end of each of the slats 68 being secured to the upper surface 64 of the second side frame 58.

A plurality of recesses 70 are formed in the upper surface 56 of the first side frame 50. More particularly, four recesses 70 are formed in the upper surface 56 of the first side frame 50 with the individual recesses being designated in FIGS. 1 and 5 by the individual reference numerals 70*a*, 70*b*, 70*c* and 70*d*. A plurality of recesses 72 (FIG. 5) are formed in the upper surface 64 of the second side frame 58 with the recesses 72 being individually designated in FIGS. 2 and 5 by the specific reference numerals 72*a*, 72*b*, 72*c* and 72*d*.

Each of the recesses 70 is aligned with one of the recesses 72. One end of each of the slats 68 is disposed in one of the recesses 70 in the opposite end of that slat is disposed in one of the recesses 72. The recesses 70 and 72 each have a sufficient depth so that the upper surface of the slats 68 is aligned with the upper surfaces 56 and 64 of the respective first and second side frames 50 and 58 in an assembled position of the slats 68 with the first and the second side frames 50 and 58. The upper surfaces of the slats 68 cooperate with the upper surfaces 56 and 64 of the first and the second side frames 50 and 58 to form the upper surface 34 of the elevation frame 24.

The slats 68 are disposed in the recesses 70 and 72 and screwed or otherwise secured to the first and the second side frames 50 and 58.

In a preferred form, the first height 38 of the elevation frame is in a range from about 2 inches to about 12 inches and preferably is about 6 inches when the elevation frame 24 is basically triangularly shaped in a side elevation view where the second height 40 is virtually zero. In those instances where the elevation frame 24 has a trapezoidally shaped side elevation view and the second height 40 is substantially greater than virtually zero, the first height 38 would be increased by an amount equal to about the second height 40 so that the particular numbers in inches just mentioned with respect to the first height actually represent the elevated height of the first end of the elevation frame 24. When a specific number of inches is mentioned with respect to the first height 38 herein, the specific number of inches means the actual elevated height of the first end 26 of the elevation frame 24 with respect to the second end 28 of the elevation frame 24 or, more particularly, the number of inches the first height 38 is greater than the second height 40 even though it may not specifically be defined in that manner.

Changes may be made in the construction and the operation of the various components, elements and assemblies of the elevation frame 24 described herein without departing from the spirit and scope of the invention as defined in the following claims.

What is claimed is:

1. A bed elevating apparatus for use with a bed frame having a first end, a second end spaced a distance from the first end, a first side and a second side spaced a distance from the first side, the bed frame being supported on a substantially horizontally extending support surface, and a mattress, comprising:

an elevation frame having a first end, a second end spaced a distance from the first end, a first side and a second side spaced a distance from the first side, an upper surface and a lower surface, the lower surface of the elevation frame being supportable on the bed frame with the first end of the elevation frame being disposed near the first end of the bed frame and the second end of the elevation frame being disposed near the second end of the bed frame, the elevation frame having a first height extending between the upper surface and the lower surface of the elevation frame about adjacent the first end of the elevation frame and a second height extending between the upper surface and the lower surface of the elevation frame about adjacent the second end of the elevation frame with the first height being greater than the second height, the upper surface of the elevation frame extending at an angle to the support surface and extending substantially in a single angularly extending plane with respect to the support surface when the elevation frame is supported on the bed frame, the mattress being supported on the upper surface of the elevation frame whereby the mattress is supported in a position extending at an angle to the support surface and the mattress being supported extending in a substantially single angularly extending plane with respect to the support surface, the elevation frame comprising:

a first side frame having a first end, a second end, an upper surface and a lower surface;

a second side frame having a first end, a second end, an upper surface and a lower surface, and means for connecting the first side frame to the second side frame whereby the first ends of the first and the second side frames cooperate to form the first end of the elevation frame, the second ends of the first and the second side frames cooperate to form the second end of the elevation frame, the upper surfaces of the first and the second side frames cooperate to form the upper surface of the elevation frame and the lower surfaces of the first and the second side frames cooperate to form the lower surface of the elevation frame, said means comprising:

at least two spaced apart slats, each slat having opposite ends and one end of each slat being connected to the first side frame and the opposite end of each slat being connected to the second side frame, the slats cooperating with the upper surfaces of the first and the second side frames to form the upper surface of the elevation frame.

2. The bed elevating apparatus of claim 1 wherein the elevation frame is about triangularly shaped in a side view.

3. The bed elevating apparatus of claim 1 wherein the bed elevating apparatus also is adapted for supporting a box spring, and wherein the box spring is supported on the upper surface of the elevation frame and the mattress is supported on the box spring.

4. The bed elevating apparatus of claim 1 wherein the elevation frame extends between the first and the second sides of the bed frame with the first side of the elevation frame being disposed near the first side of the bed frame and the second side of the elevation frame being disposed near the second side of the bed frame.

5. The bed elevating apparatus of claim 1 wherein the first height is defined further as being in a range from about 2 inches to about 12 inches.

6. The bed elevating apparatus of claim 1 wherein the first height is defined further as being about 6 inches.

7. A bed elevating apparatus supportable on a substantially horizontally extending support surface comprising:

a bed frame having a first end, a second end spaced a distance from the first end, a first side and a second side spaced a distance from the first side;

a mattress; and an elevation frame having a first end, a second end spaced a distance from the first end, a first side and a second side spaced a distance from the first side, an upper surface and a lower surface, the lower surface of the elevation frame being supportable on the bed frame with the first end of the elevation frame being disposed near the first end of the bed frame and the second end of the elevation frame being disposed near the second end of the bed frame, the elevation frame having a first height extending between the upper surface and the lower surface of the elevation frame about adjacent the first end of the elevation frame and a second height extending between the upper surface and the lower surface of the elevation frame about adjacent the second end of the elevation frame with the first height being greater than the second height, the upper surface of the elevation frame extending at an angle to the support surface and extending substantially in a single angularly extending plane with respect to the support surface when the elevation frame is supported on the bed frame, the mattress being supported on the upper surface of the elevation frame whereby the mattress is supported in a position extending at an angle to the support surface and the mattress being supported extending in a substantially single angularly extending plane with respect to the support surface, the elevation frame comprising:

a first side frame having a first end, a second end, an upper surface and a lower surface;

a second side frame having a first end, a second end, an upper surface and a lower surface, and means for connecting the first side frame to the second side frame whereby the first ends of the first and the second side frames cooperate to form the first end of the elevation frame, the second ends of the first and the second side frames cooperate to form the second end of the elevation frame, the upper surfaces of the first and the second side frames cooperate to form the upper surface of the elevation frame and the lower surfaces of the first and the second side frames cooperate to form the lower surface of the elevation frame, said means comprising:

at least two spaced apart slats, each slat having opposite ends and one end of each slat being connected to the first side frame and the opposite end of each slat being connected to the second side frame, the slats cooperating with the upper surfaces of the first and the second side frames to form the upper surface of the elevation frame.

8. The bed elevating apparatus of claim 7 wherein the elevation frame is about triangularly shaped in a side view.

9. The bed elevating apparatus of claim 7 further comprising:

a box spring; and wherein the bed elevating apparatus also is adapted for supporting a box spring, and wherein the box spring is supported on the upper surface of the elevation frame and the mattress is supported on the box spring.

10. The bed elevating apparatus of claim 7 wherein the elevation frame extends between the first and the second sides of the bed frame with the first side of the elevation frame being disposed near the first side of the bed frame and the second side of the elevation frame being disposed near the second side of the bed frame.

11. The bed elevating apparatus of claim 7 wherein the first height is defined further as being in a range from about 2 inches to about 12 inches.

12. The bed elevating apparatus of claim 7 wherein the first height is defined further as being about 6 inches.

* * * * *